US006978968B1

(12) United States Patent
King et al.

(10) Patent No.: US 6,978,968 B1
(45) **Date of Patent: *Dec. 27, 2005**

(54) DEPLOYABLE FLARE FOR AERODYNAMICALLY STABILIZING A PROJECTILE

(75) Inventors: Hartley Hughes King, Santa Barbara, CA (US); Thomas Louis Menna, Santa Barbara, CA (US); Lawrence Steven Romero, Santa Ynez, CA (US)

(73) Assignee: AT&T Corp., New York, NY (US)

( * ) Notice: Subject to any disclaimer, the term of this patent is extended or adjusted under 35 U.S.C. 154(b) by 56 days.

This patent is subject to a terminal disclaimer.

(21) Appl. No.: 10/886,307

(22) Filed: Jul. 7, 2004

Related U.S. Application Data

(63) Continuation of application No. 10/396,221, filed on Mar. 24, 2003, now Pat. No. 6,783,095.

(51) Int. Cl.[7] ..... F42B 15/10

(52) U.S. Cl. ..... 244/3.28; 244/3.27; 244/3.29; 102/520; 102/377; 102/400

(58) Field of Search ..... 102/520, 377, 102/400, 439; 244/3.24–3.29, 110 D, 113; 411/340–345

(56) References Cited

U.S. PATENT DOCUMENTS 1,104,889 A * 7/1914 Howes ..... 244/110 D
3,016,910 A 1/1962 Rosenkaimer
3,047,259 A * 7/1962 Tatnall et al. ..... 244/113
3,158,336 A 11/1964 Warren
3,702,588 A 11/1972 Simmons
3,834,312 A 9/1974 Simmons
3,952,662 A * 4/1976 Greenlees ..... 102/400
4,004,514 A 1/1977 Daniels
4,295,290 A * 10/1981 Boswell
H0905 H * 4/1991 Rottenberg ..... 244/3.28
5,020,436 A * 6/1991 Coburn ..... 102/377
5,452,864 A * 9/1995 Alford et al. ..... 244/3.23
6,053,188 A * 4/2000 Walker
6,234,082 B1 * 5/2001 Cros et al. ..... 102/520
6,454,205 B2 * 9/2002 Niemeyer et al. ..... 244/3.26
6,502,786 B2 * 1/2003 Rupert et al. ..... 244/3.27
6,520,193 B2 2/2003 You
6,576,880 B2 6/2003 Martorana

* cited by examiner

*Primary Examiner*—Michael J. Carone
*Assistant Examiner*—L. Semunegus
(74) *Attorney, Agent, or Firm*—Ronald D. Slusky

(57) ABSTRACT

The center of pressure of a projectile is caused to move upon the occurrence of an event that changes the static margin, such as the jettisoning of a body previously attached to the projectile, as noted above. In particular embodiments, this is achieved by a flare disposed toward the rear of the projectile. The flare has petals that deploy from a first, stowed position to a second, deployed position upon the occurrence of said event. In the stowed position, the petals are aligned with the air stream, in order to minimize drag. In the deployed position, the petals project into the air stream in such a way as to move the lift center rearward. A slide ring within the flare has sufficient inertia that it shifts aft in response to an acceleration that occurs when the attached body and the projectile are separated from one another. The slide ring is linked to the petals in such a way that the petals are deployed by the displacement of the slide ring. The slide ring is prevented from moving aft during launch of the projectile by slide supports which separate from the aft body when the separation event occurs. Detents lock the slide ring in its displaced position.

4 Claims, 6 Drawing Sheets

DEPLOYABLE FLARE FOR AERODYNAMICALLY STABILIZING A PROJECTILE

BACKGROUND OF THE INVENTION

This is a continuation of U.S. patent application Ser. No. 10/396,221 filed Mar. 24, 2003 now U.S. Pat. No. 6,783,095.

BACKGROUND OF THE INVENTION

The present invention relates to the stabilization of projectiles in flight.

The invention more particularly relates to the aerodynamic stabilization of projectiles of a type that, during flight, are designed to jettison either a forward or an aft body that was connected to the projectile when it was initially launched, as from a gun or a missile. Those skilled in the art are well aware of the context or contexts in which such a mode of operation occurs.

Aerodynamic stabilization of a projectile in flight, i.e., preventing it from tumbling, is achieved by making the center of the lifting forces, also referred to as the center of pressure, lie behind the center of mass. The distance between these centers and divided by the total projectile length is called the static margin. Even if the projectile is stable when launched, its static margin may sufficiently change after the body that was attached to it is jettisoned that the static margin is no longer sufficient to ensure stable flight.

Reference is made to our co-pending and commonly-assigned United States patent application Ser. No. 10/396,222, filed of even date herewith, entitled, "Aerodynamic Stabilization of a Projectile," and hereby incorporated herein by reference. In accordance with the invention set forth in that patent application, the lift force center, or center of pressure, of a projectile is caused to move upon the occurrence of an event that changes the static margin, such as the jettisoning of a body previously attached to the projectile. This is illustratively achieved by a flare disposed toward the rear of the projectile. The flare has elements that deploy from a first, stowed position to a second, deployed position upon the occurrence of the jettisoning, or separation, event. In the stowed position, the deployable elements are aligned with the air stream, in order to minimize drag. In the deployed position, the deployable elements project into the air stream in such a way as to move the lift center rearward. Deployment of the deployable elements is illustratively achieved by taking advantage of an abrupt change in velocity (i.e., an acceleration or deceleration) that occurs when the attached body and the projectile are separated from one another by, for example, the setting off of a propellant charge that drives them apart while in flight. An inertial component of the flare, illustratively a slide ring, is arranged to shift position relative to the rest of the flare in response to the abrupt velocity change and is connected to the deployable elements in such a way, and has sufficient inertia, as to move the deployable elements to their deployed positions upon separation. A detent mechanism is provided to lock the deployable elements in place once they have been moved to their deployed position. This is illustratively achieved by locking the aforementioned inertial component in its displaced position. The deployable elements comprise a number of petals each hinged at one end to a support ring and arrayed around a central axis of the flare. The inertial component is, as previously mentioned, illustratively a slide ring to which each petal is linked in such a way that the displacement of the slide ring swings the petals around their hinged ends to their deployed positions. The projectile launch acceleration may be on the order of four times as large as the separation acceleration. In order to prevent the aforementioned inertial component from prematurely deploying the deployable elements during the launch acceleration of the projectile, the flare illustratively includes a plurality of slide supports, supported by a retaining element, thereby keeping the shifting element and the deployable elements in their original positions. The retaining element also engages with the deployable elements to preclude any fluttering in flight that might occur while they are in their stowed position. The retaining element detaches from the rest of the flare at the separation event, thereby allowing the deployable elements to deploy under the influence of the inertial component.

SUMMARY OF THE INVENTION

The present invention is directed to an embodiment of the invention set forth in the above-cited patent application.

In accordance with a feature of the invention the aforementioned detent mechanism is illustratively a set of fingers, or detents, whose position is fixed relative to the support member. Each detent rests on a respective protrusion on the outside of the slide ring. When the slide ring shifts to its displaced position, the protrusions are pulled out from under their respective detents. The detents are biased inwardly and so slip into place behind their respective protrusions, thus locking the slide ring in place, preventing it from returning to its original position, and thereby maintaining the petals in their outwardly swung position.

There are illustratively six of the aforementioned slide supports in the form of a right pentagonal prism wedged between the slide ring and the retaining element. When the retaining element detaches from the rest of the flare, the slide supports simply fall away. The retaining element itself illustratively comprises a segmented ring made up of six wedges, or ring segments. A lip on one side of each ring braces against the aft body and a lip on the other side of each ring segment engages a respective one of the petals so as to prevent any possible fluttering of the petal during flight, as already mentioned. The ring segments are held in place by being wedged between the aft body and the projectile but are not permanently affixed to either of them. They simply fall away when the aft body and projectile separate.

The embodiment to which the present invention is directed has six of the aforesaid petals.

A different embodiment of a flare embodying the principles of the invention is the subject matter of co-pending and commonly-assigned United States patent application Ser. No. 10/396,220 filed of even date herewith entitled, "Deployable Flare With Simplified Design," the applicants of that patent application being John Daryl Carlyle, William Leroy Hall, Hartley Hughes King, Thomas Louis Menna, Lawrence Steven Romero. That application is also hereby incorporated herein by reference.

DETAILED DESCRIPTION OF AN ILLUSTRATIVE EMBODIMENT

Figure 1:
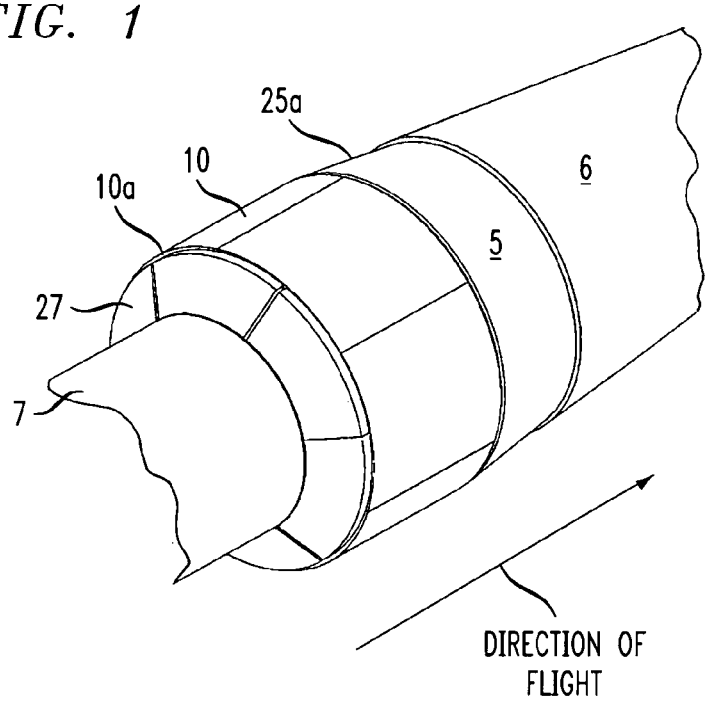
FIG. 1 shows a deployable flare embodying the principles of the invention attached to a portion of the projectile whose flight the flare is intended to stabilize.

FIG. 1 shows a flare 5 embodying the principles of the present invention attached to a projectile 6 whose intended direction of flight is as shown. An aft body 7 extends through the center of flare 5 and is attached to the internal body of projectile 6.

Figure 2:
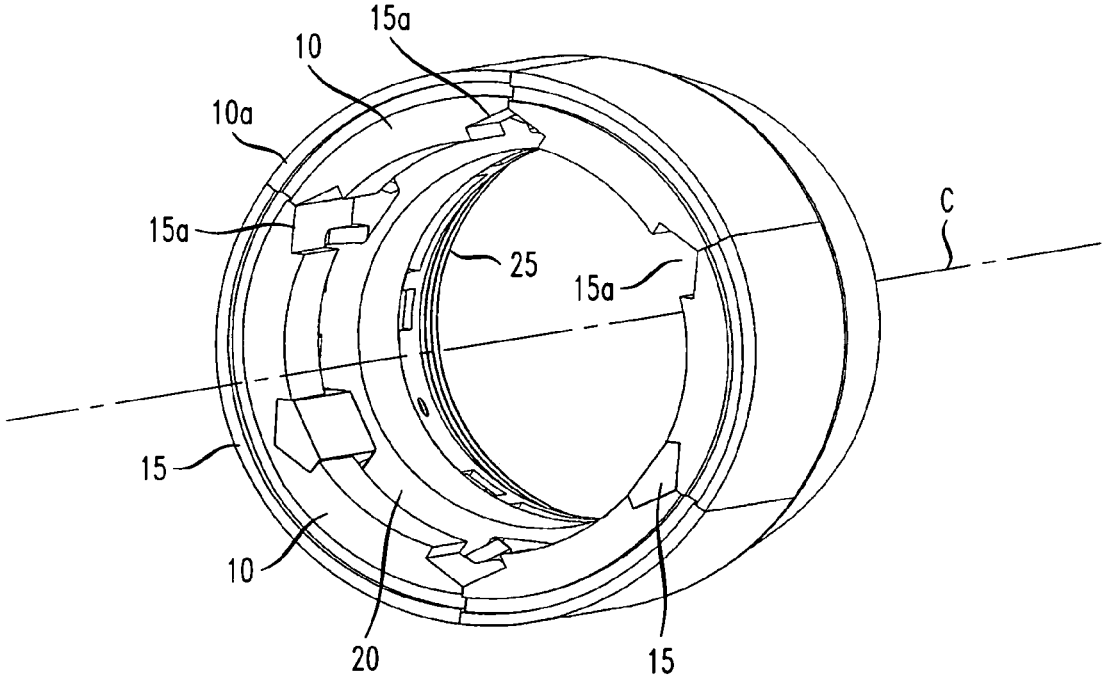
FIG. 2 shows the deployable flare in a stowed configuration.
Figure 3:
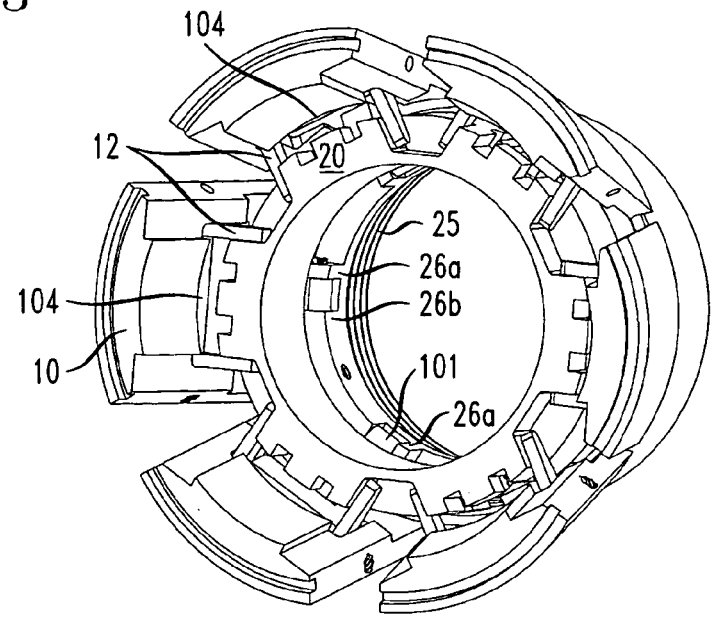
FIG. 3 shows the deployable flare in a deployed configuration.
Figure 4:
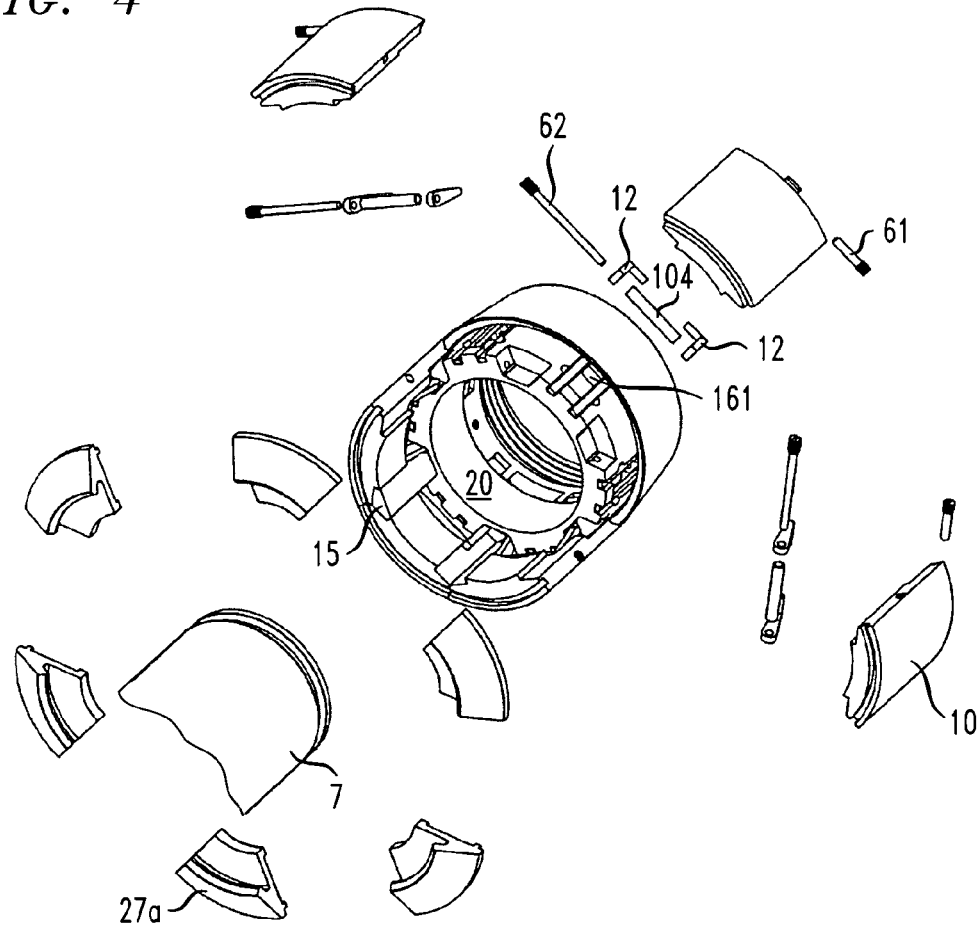
FIG. 4 is an exploded view of the flare.

The construction of flare 5 can be seen in FIGS. 2 through 4. The flare includes a threaded support ring 25 that threads onto projectile 6, with an aft portion of projectile 6 (not shown) extending through the center of the flare. Attached to support ring 25 are six petals 10 arrayed in a first position around central axis C of the flare. Petals 10 are each in the form of a cylindrical segment whose side edges meet to form a cylinder whose central axis is coincident with the central axis of the flare. A wind shield 25*a* threaded onto support ring 25 provides smooth aerodynamic transition from the projectile body diameter to the deployable flare diameter to minimize aerodynamic drag.

Figure 5:
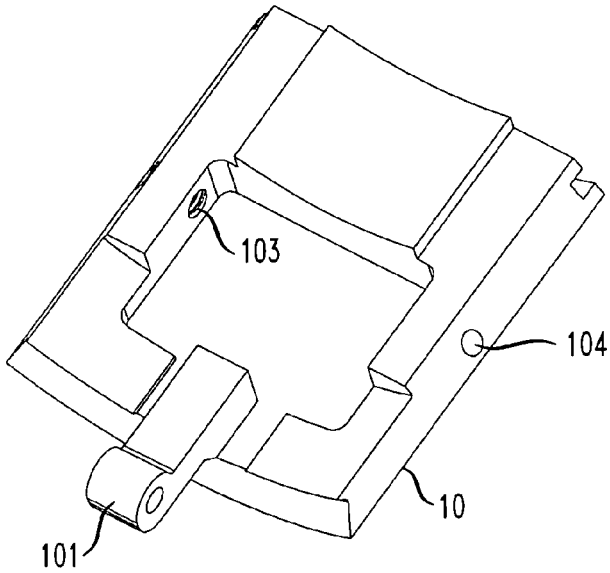
FIG. 5 shows the interior surface of one of the petals of the flare.
Figure 11:
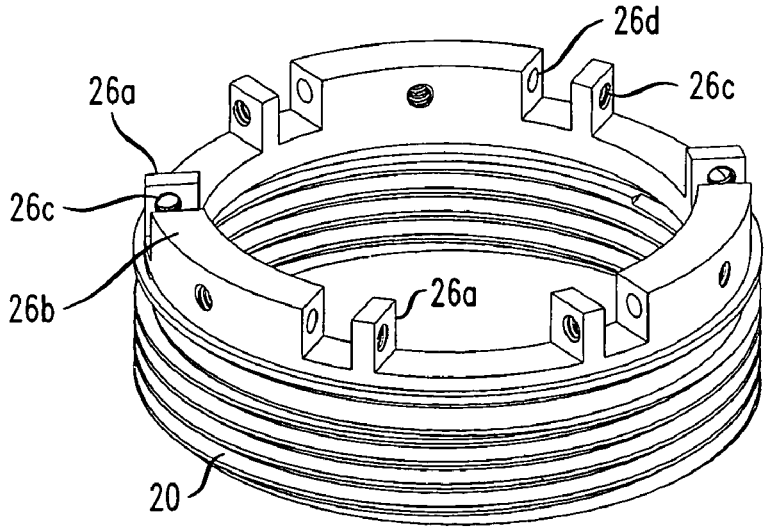
FIG. 11 shows the flare's support ring.

A detailed view of one of the petals 10 is shown in FIG. 5. A hinge element 101 is disposed on the forward edge of petal 10. The hinge element 101 of each petal mates with hinge components 26*a* and 26*b* on support ring 25, as can be seen in FIG. 11. Hinge element 101 is held between hinge elements 26*a* and 26*b* by a pin 61 (shown in FIGS. 4 and 6) having a threaded end that is threaded into threaded opening 26*c* in hinge element 26*a*. The non-threaded end of pin 61 is inserted into opening 26*d* in hinge component 26*b*. This hinging arrangement enables the aft edges 10*a* of petals 10 to swing outwardly from the central axis of the flare, thereby moving from a stowed, undeployed, or closed position, as shown in FIGS. 1 and 2, to a deployed, or open position, as shown in FIG. 3.

Figure 10:
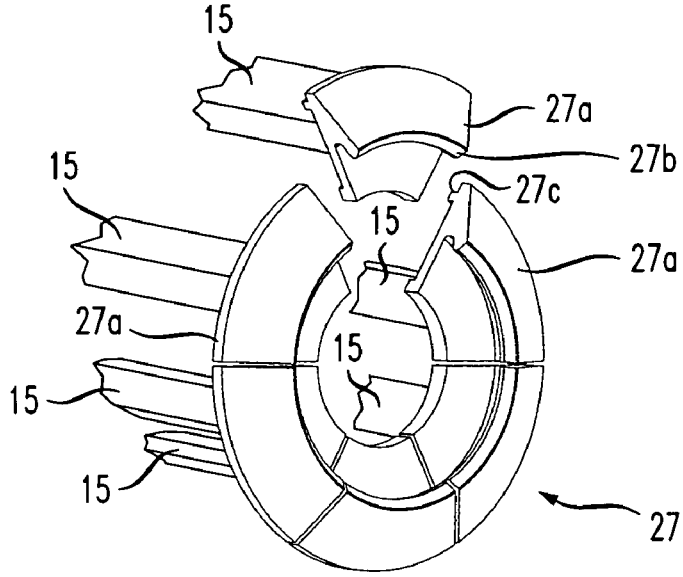
FIG. 10 shows a petal retaining ring that forms a part of the flare.

A petal retaining ring 27 comprises a segmented ring made up of six wedge segments 27*a*, as seen in FIG. 10. A lip 27*b* on one side of each wedge segment engages aft body 7. A lip 27*c* on the other side of each ring segment engages a respective one of petals 10 so as to prevent any possible fluttering of the petal during flight. The ring segments are held in place by being wedged between aft body 7 and projectile 6 but are not permanently affixed to either of them. The segments 27*a* simply fall away when the aft body and projectile separate, allowing petals 10 to be moved to the open position.

Figure 6:
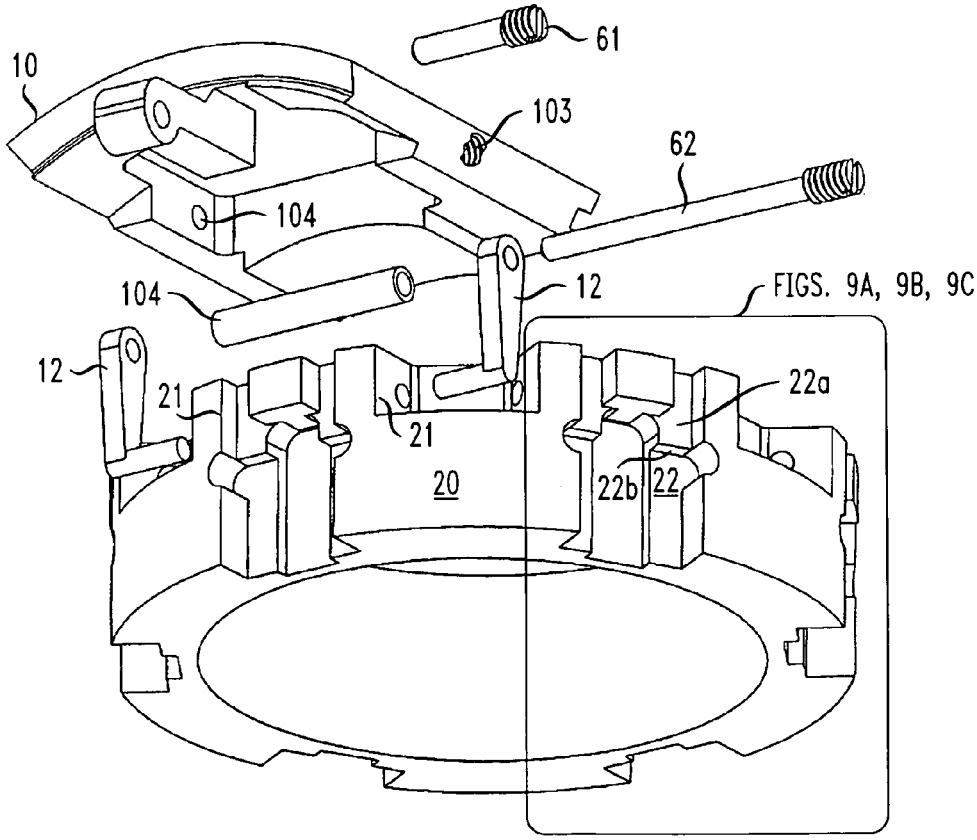
FIG. 6 shows how the petals are linked to the flare's slide ring.

Flare 5 further includes an inertial component in the form of slide ring 20 centered on axis C. As can be seen in FIG. 6, for example, disposed on slide ring 20 are hinge elements 21. Links 12 interconnect hinge elements 21 with corresponding ones of petals 10. In particular, a pin 62 passes through opening 103 in petal 10 (FIG. 5) and thence through one of the links 12, spacer 104, a second one of links 12 and into a second opening 104 in petal 10. The threaded end of pin 62 threads into opening 103. Slide ring 20 along with the linkages just described thus form part of an actuating mechanism for the petals in that rearward motion of slide ring 20 parallel to axis C from its original position (as seen in FIG. 2) to a displaced position (as seen in FIG. 3) swings petals 10 from their closed to their open positions. Once in its open position, the flare adds a significant among of drag to the flying projectile. Note that unlike a fin, it is the broad side of the petal that is presented to the air stream. In applications in which the remainder of the projectile's flight is expected to be quite short, this additional drag is not of concern. For applications that require lower drag for longer flights, the petal design can be modified as needed.

Flare 5 further includes six slide supports 15 each in the approximate form of a right pentagonal prism. Two of the slide supports are shown in FIG. 2. The other four slide supports are not shown in FIG. 2 in order to depict channels 15*a* in which the slide supports are held. Each one of channels 15*a* is formed by the side edges of two of the petals. When the flare is in its closed position, slide supports 15 are wedged between slide ring 20 and petal retaining ring 27. In this way, petal retaining ring 27 serves as a base for the slide supports, as depicted in FIG. 10, to react the structural load placed on the slide ring when the projectile is initially launched. Once the segments 27*a* fall away when aft body 7 is separated from projectile 6, slide supports simply fall out of the flare.

Figure 7A:
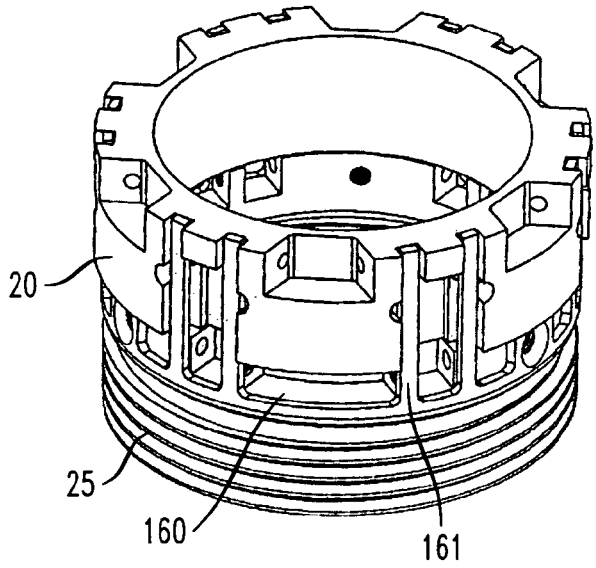
FIGS. 7*a* and 7*b* show the support ring and the flare's slide ring (inertial component) in the latter's original and displaced positions.
Figure 7B:
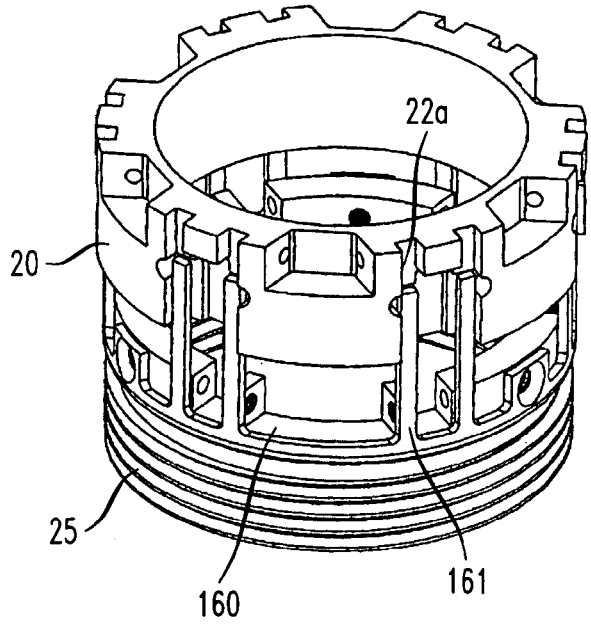
Figure 8:
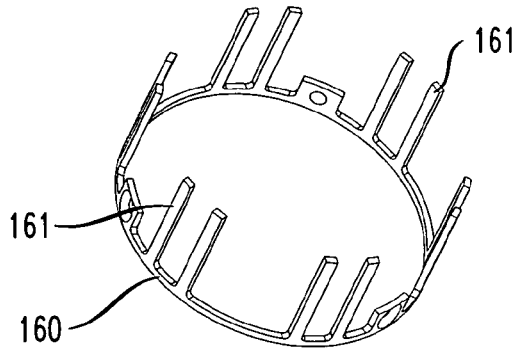
FIG. 8 shows the flare's detents.
Figure 9A:
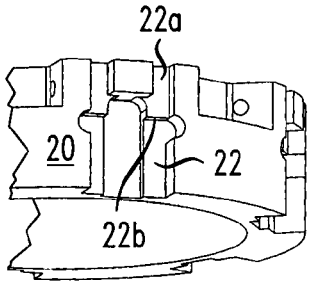
FIGS. 9*a* through 9*c* show a detail of the slide ring and illustrate the operation of the detent mechanism.
Figure 9B:
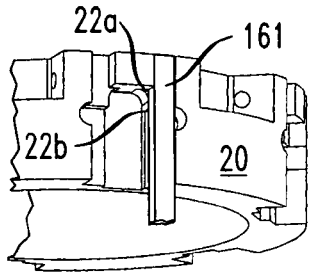
Figure 9C:
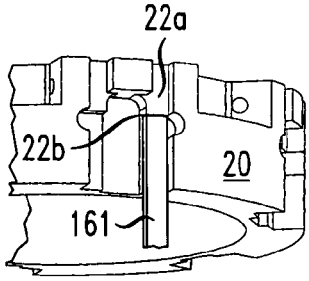

FIGS. 7*a* and 7*b*, 8 and 9*a* through 9*c* illustrate how slide ring 20, and thus petals 10, are locked in place once the slide ring has shifted to its displaced position. FIG. 7*a*, in particular, shows slide ring 20 in its original position. As seen in FIG. 7*a*, a detent ring 160 having six pairs of fingers, or detents 161 is attached to support ring 25. A full view of detent ring 160 is presented in FIG. 8. Each detent 161 is disposed within a respective slot 22 around the periphery of slide ring 20. Slot 22 includes a protrusion 22*a* at the aft edge of slide ring 20 (the upper edge of slide ring 20 as viewed in FIGS. 7*a*, 7*b* and 9*a* through 9*c*). When the slide ring is in its original position, as shown in FIGS. 7*a* and 9*b*, each detent rests on its respective protrusion 22*a*. Once the slide ring shifts to its displaced position, as shown in FIG. 7*b*, the protrusions are pulled aft (i.e., upward in these FIGS.) and are thus pulled out from under their respective detents 161. The detents are biased inwardly toward the center of the slide ring. They thus slip into place behind their respective protrusions, as seen in FIG. 9*c*. Any tendency of slide ring 20 to move toward its original position is prevented by the engagement of each detent 161 with edge 22*b* of its respective protrusion, as FIG. 9*c* shows. Slide ring 20 is thus locked in place and prevented from returning to its original position. Petals 10 are thus maintained in their outwardly swung position.

In operation, the entire assembly comprising projectile 6, flare 5, aft body 7 are initially launched as a unit. The static margin of that overall assembly is sufficient to ensure stable flight of the overall assembly.

During flight, however, a chemical or mechanical instrumentality (not shown) internal to projectile 6 pushes against an element that ultimately connects to aft body 7 and causes aft body 7 to be jettisoned. Such arrangements, and the purposes to which they can be put are known to those skilled in the art and need not be described herein. Suffice it to say that the separation event causes projectile 6 to be accelerated in the direction of flight.

The static margin of projectile 6 after detached from aft body 7 would be insufficient to ensure that projectile 6 will fly stably for the duration of its flight. However, once in its open position, flare 5 causes the center of pressure of projectile 6 to more rearward to thus increase the static margin and ensure stability for the remainder of the flight of projectile 6.

More particularly, the jettisoning of aft body 7 allows petal retaining ring segments 27*a* to fall away, removing support from slide supports 15 so that the petals are no longer inhibited from opening. The configuration of the flare is such that all of the petals deploy simultaneously and symmetrically. The petals therefore disturb the air stream in a way that will not cause a disturbance of the projectile flight path.

The magnitude of the acceleration of projectile 6 and the mass of slide ring 20 are such that the latter's inertia gives rise to its rearward motion relative to support ring 25. (From the pure physics standpoint, one in a stationary reference frame might observe that it is not that slide ring 20 is moving rearward but that support ring 25 is accelerating forward but, of course, the effect is the same.) As noted earlier, detents 161 lock slide ring 20 in its displaced location, thereby locking petals 10 into the open position.

A mechanism by which aft body 7 is connected to projectile 6 is described in the above-cited co-pending patent application. A similar mechanism may be used in the illustrative embodiment described herein. The present illustrative embodiment may also include a slide stop ring such as shown in the co-pending application to prevent slide ring 20 from continuing to move off the end of projectile 6 when the flare is opening or thereafter and to provide other functions as described in the co-pending patent application.

The mass and design of the slide ring and the other components should be selected and balanced in such a way to adjust the various forces at play. Given an anticipated level of acceleration of the projectile during the separation event, a large enough force must be exerted by slide ring 20 to deploy the petals but its rearward velocity should not be so large that it rebounds so quickly from the aforementioned slide ring stop that the detents do not have time to return to a bent state and lock the slide ring in place or that the stopping forces are large enough to buckle the detents. This design balance should also include consideration of the forces exerted on the petals, for example, by the air stream at the flight velocity.

The components of the flare can be made out of any desired materials which can withstand the zero heat transfer recovery temperature of the air stream and initial launch acceleration loads. In one embodiment that was built, all components were made of metal; the petals were of titanium and the other components were of steel. However, it is expected that an all-steel construction would be more economical to manufacture but would perform just as well.

Although in the illustrative embodiment aft body 7 is directly connected to projectile 6, a separate coupling element could be use to connect them. That coupling element would form a part of the aft body in the sense that it would remained connected to the aft body at the separation event.

The foregoing merely illustrates the principles of the invention. For example, in some applications it might be intended for the aft body to continue to fly, but its static margin might be insufficient after the separation event, in which case it might be desired for the aft body to include a flare such as that that disclosed herein. However, if the aft body experiences a deceleration during the separation event, the slide ring will not move aft; to the contrary it will be urged forward. Thus any such flare would have to be configured in such a way that the slide ring is allowed to slide forward upon separation and it would have to be linked to the petals in such a way that they open in response to such forward movement of the slide ring.

It will thus be appreciated that those skilled in the art will be able to devise numerous arrangements which, although not shown or described herein, embodying the principles of the invention and thus are within its spirit and scope.

What is claimed is:

1. Apparatus comprising a projectile, a support member attached to the projectile, a plurality of petals each hinged at an end thereof to the support member, the petals being arrayed in a first position around a central axis of the apparatus in a first, undeployed configuration of the apparatus, actuating means operable to swing each of the petals around its hinged end to a second position in a second, deployed configuration of the apparatus, and means attached to the support member for locking the petals in said second position, each of the petals being hinged to the support member using a hinge mechanism that includes at least a first pin that passes into the support member, and each of the petals being linked to the actuating means using a hinge mechanism that includes at least a second pin that passes into that petal.

2. The apparatus of claim 1 wherein there are six of said petals.

3. The apparatus of claim 1 wherein the actuating means is operable to move in a direction away from the support member, and wherein it is the movement of the actuating means in a direction away from the support member that causes said each of the petals to swing around its hinged end to the second position.

4. Apparatus comprising a projectile, a support member attached to the projectile, a plurality of petals each hinged at an end thereof to the support member, the petals being arrayed in a first position around a central axis of the apparatus in a first, undeployed configuration of the apparatus, actuating means operable to swing each of the petals around its hinged end to a second position in a second, deployed configuration of the apparatus, and means attached to the support member for locking the petals in said second position, each of the petals being hinged to the support member using a hinge mechanism that includes at least a first pin that passes into the support member, and each of the petals being linked to the actuating means using a hinge mechanism that includes at least one link, one end of the link being hinged to the actuating means and another end of the link being hinged to a respective one of the petals.

* * * * *